US005417369A

United States Patent [19]

Lipson

[11] Patent Number: 5,417,369

[45] Date of Patent: May 23, 1995

[54] DRINKING STRAW ASSEMBLY

[76] Inventor: Erik Lipson, 213 S. Bonsall St., Philadelphia, Pa. 19103

[21] Appl. No.: 176,267

[22] Filed: Jan. 3, 1994

[51] Int. Cl.[6] ..... A47G 21/18

[52] U.S. Cl. ..... 239/33; 239/152; 239/211; 446/27; 446/200; D7/300.2

[58] Field of Search ..... 239/33, 211, 152, 153; 222/175; 446/200, 27; D7/300.2

[56] References Cited

U.S. PATENT DOCUMENTS

| | | | |
|---|---|---|---|
| D. 291,893 | 9/1987 | Lipson | D16/111 |
| D. 321,106 | 10/1991 | Whitright | D7/300.2 |
| D. 330,142 | 10/1992 | McNerney et al. | D7/300.2 |
| D. 330,143 | 10/1992 | McNerney et al. | D7/300.2 |
| D. 332,547 | 1/1993 | Lipson | D7/300.2 |
| D. 333,940 | 3/1993 | McNerney et al. | D7/300.2 |
| D. 334,582 | 4/1993 | Whitright | D16/122 |
| 3,879,885 | 4/1975 | Fabricant | 46/44 |
| 4,687,306 | 8/1987 | Lipson et al. | 351/51 |
| 4,828,355 | 5/1989 | Lipson et al. | 351/51 |
| 5,184,774 | 2/1993 | Lipson | 239/33 |
| 5,207,719 | 5/1993 | Janus | 224/148 |

OTHER PUBLICATIONS

Crazy Glasses, Fun-Time Int'l, Mar. 1990.

*Primary Examiner*—Andres Kashnikow
*Assistant Examiner*—Christopher G. Trainor
*Attorney, Agent, or Firm*—Gifford, Krass, Groh, Sprinkle, Patmore, Anderson & Citkowski

[57] ABSTRACT

A tubular drinking straw assembly adapted to be positioned on the user's head and defining an icon above the user's head of any desired configuration such for example as an animal depiction. The straw assembly includes ascending and descending portions positioned along opposite sides of the user's head and intersecting below the chin of the user where they are intertwined utilizing a connector clip to firmly position the straw assembly on the user's head and preclude inadvertent displacement of the assembly from the user's head. The movement of a colored and/or effervescent liquid from a beverage container and through the straw assembly to the user's mouth creates a colorful, sparkling and jocular party atmosphere.

20 Claims, 5 Drawing Sheets

70
78
68
76
32
74
78
18
22b
28a
28b
22c
16a
22a
22
24
28
28c
30
26c
26a
24a
22d
32
26
26b
20b
16
16a
10
20a
20
20c

DRINKING STRAW ASSEMBLY

FIELD OF THE INVENTION

This invention relates to drinking straw assemblies and more particularly to drinking straw assemblies that include portions that may be positioned on the user's head to simulate animals or other icons above the user's head.

BACKGROUND OF THE INVENTION

Drinking straws are in common use to provide a convenient, effective and neat means of conveying a beverage from a container to the user's mouth.

It has previously been proposed to combine the utility aspects of a drinking straw with non-utility aspects. For example, it has been proposed to combine a drinking straw with a hollow eyeglass frame assembly so that the beverage passes through the eyeglass frame during its passage from the container to the user's mouth. It has further been proposed to configure the straw assemblies so that a portion of the assembly may be positioned on the user's head where it creates certain aesthetic effects proximate the ears or temples of the user's head.

SUMMARY OF THE INVENTION

This invention is directed to the provision of an improved drinking straw assembly.

More specifically this invention is directed to the provision of an improved drinking straw assembly that allows the user to assume a variety of appearances depending on the specific configuration of the straw assembly.

The invention drinking straw assembly includes a discharge section at one end of the assembly adapted to be inserted in the user's mouth, an inlet section at the other end of the assembly adapted to be inserted into a beverage to be sipped, and a central section between the discharge end section and the inlet end section.

According to the invention, the central section is configured to be positioned on the head of the user and the central section, when positioned on the user's head, presents a portion extending above the user's head and defining an icon above the user's head. This arrangement allows the drinking straw assembly to be effectively configured to define any of a plurality of icons above the user's head depending on the particular configuration of the icon portion of the central section.

According to a further feature of the invention, the central section is configured to be positioned on the head of the user and includes a first portion connected to one end of the inlet end section and a second portion connected to one end of the discharge end section and, with the central section positioned on the user's head, the first and second portions intersect. The intersecting arrangement facilitates the positioning and maintaining of the central section on the user's head.

According to a further feature of the invention, the first portion comprises an ascending portion extending upwardly with respect to the user's head from the inlet end section, the second portion comprises a descending portion extending downwardly with respect to the user's head for connection to the discharge end section, and the ascending portion and descending portion intersect beneath the chin of the user. This arrangement allows the straw assembly to be positioned and maintained on the user's head utilizing the intersection of the ascending descending portion beneath the chin of the user.

According to a further feature of the invention, the ascending and descending portions are intertwined at their intersection to facilitate positioning of the straw assembly on the user's head and to preclude displacement of straw assembly from the user's head.

In the disclosed embodiment of the invention, the icon presented above the user's head by the straw assembly comprises an animal depiction such, for example, as animal appendages including animal ears, animal fins, or animal antlers.

DETAILED DESCRIPTION OF THE PREFERRED EMBODIMENTS

Figures 1, 14:
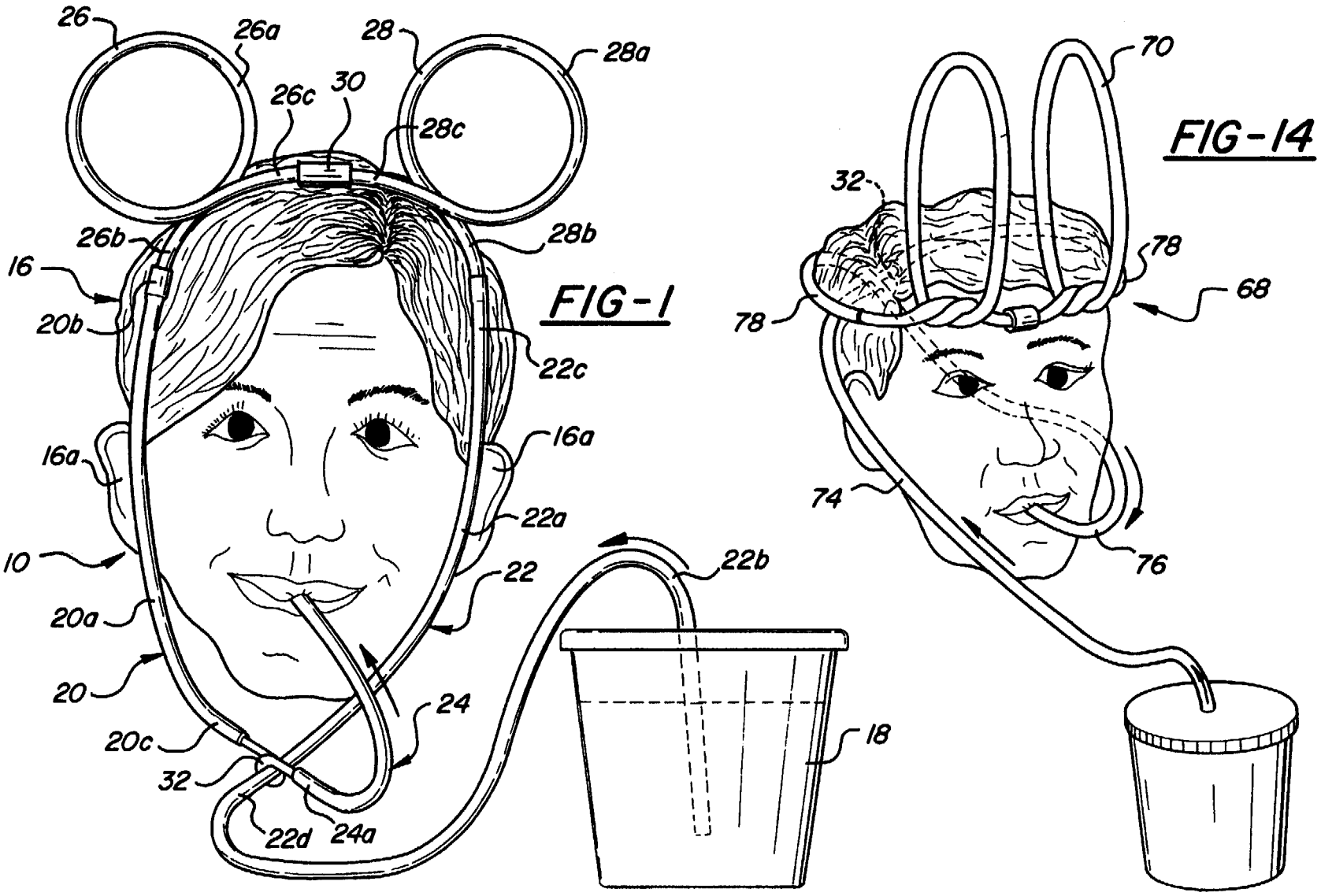
FIG. 1 is a view of a straw assembly according to the invention shown in position on the user's head.
FIGS. 6–14 show various design configurations of the invention straw assembly.
Figure 2:
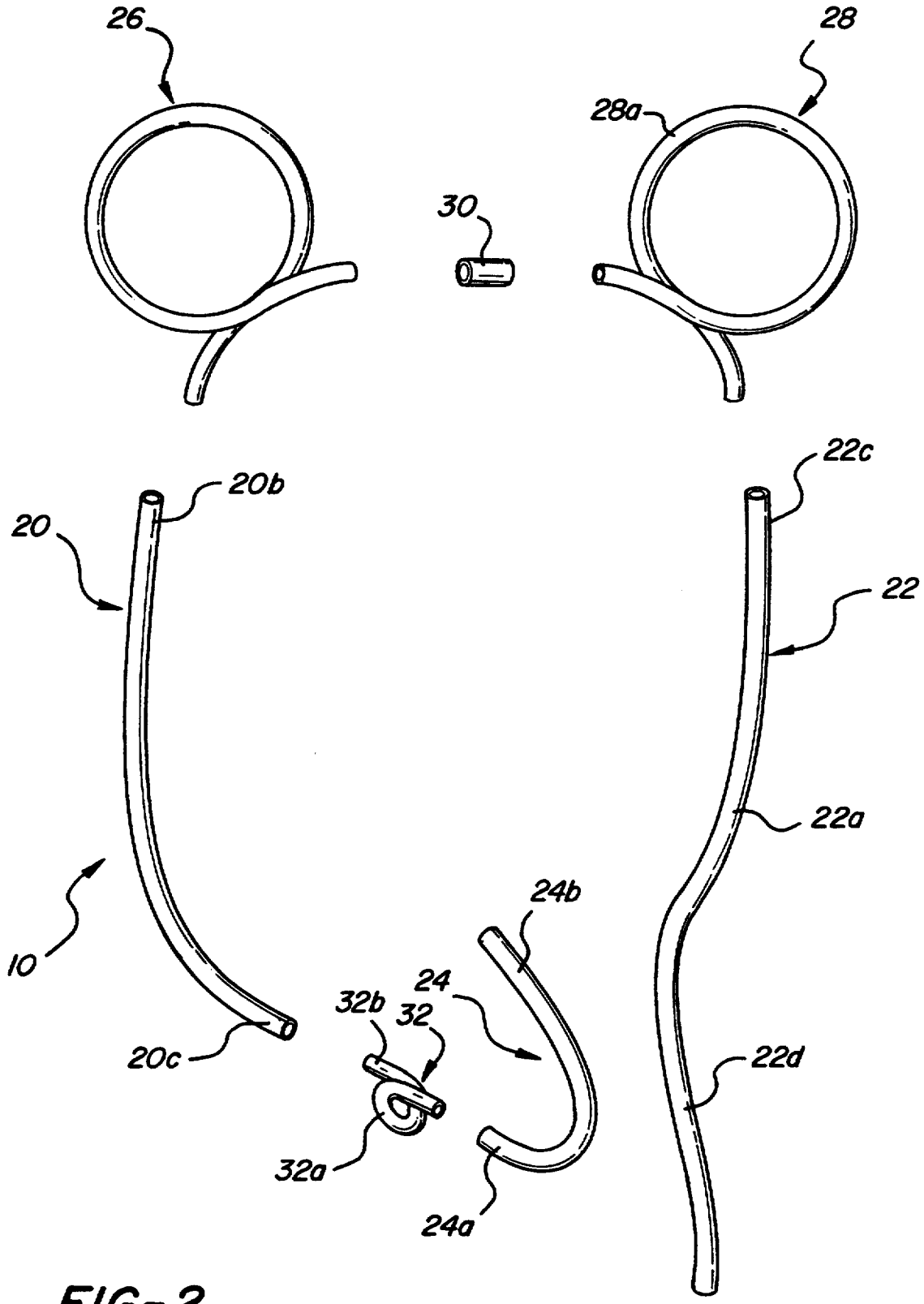
FIG. 2 is a view showing the straw assembly of FIG. 1 in a disassembled configuration.
Figure 3:
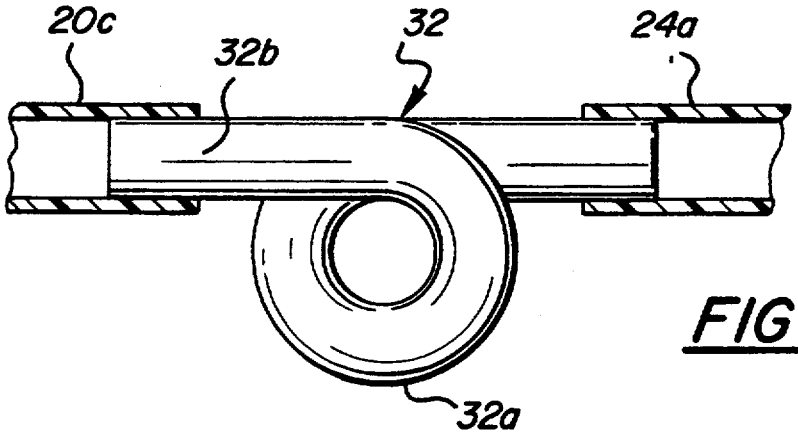
FIG. 3 shows a connector clip utilized in the invention straw assembly.

One preferred form of the invention straw assembly is seen in FIGS. 1 and 2. The straw assembly 10 seen in FIGS. 1 and 2 comprises a plurality of flexible and rigid tubular straw sections, formed of a transparent plastic material or other suitable transparent material, which are adapted to be joined together and which, when joined together, define a continuous liquid passage extending from a cup 12 to the mouth 14 of a user 16 so that, in known fashion, liquid 18 in the cup 12 may be sucked through the continuous passage defined by the straw assembly for discharge into the user's mouth 14.

Specifically, straw assembly 10 includes a flexible tubular piece 20, a flexible tubular piece 22, a flexible tubular piece 24, a rigid tubular piece 26, a rigid tubular piece 28, a flexible connector 30, and a rigid connector clip 32.

Rigid tubular piece 26 includes a central loop portion **26*a*, configured in the form of a mouse ear, a lower or outboard end 26*b*, and an upper or inboard end 26*c*; rigid tubular piece 28 includes a central loop portion 28*a*, configured in the form of a mouse ear, a lower or outboard end 28*b*, and an upper or inboard end 26*c*; and connector clip 32 includes a central loop portion 32*a* and end portions 32*b* and 32*c***.

The various pieces are shown in a disassembled relationship in FIG. 2 and in their assembled relationship with respect to the user's head 16 in FIG. 1.

As seen in FIG. 1, in the assembled relation of the pieces and with the assembly positioned on the user's head, the main body portion **22*a* of flexible piece 22 is positioned along one side of the user's face; the lower end 22*b* of piece 22 defines an inlet end section of the straw assembly adapted to be inserted into cup 12 to access beverage 18; the main body portion 20*a* of flexible piece 20 is positioned along the other side of the user's face; the central loop portion 28*a* of rigid piece 28 is positioned on top of and on one side of the user's head to simulate a first mouse ear with the lower end 28*b* of the piece positioned telescopically within the upper end 22*c* of flexible piece 22; the loop portion 26*a* of rigid piece 26 is positioned on the other side and on top of the user's head to simulate a second mouse ear with the lower end 26b of the piece received telescopically within the upper end 20b of flexible piece 20; flexible clip 30 is positioned centrally on the user's head between pieces 26 and 28 and telescopically receives the upper or inboard end 26c of rigid piece 26 and the upper or inboard end 28c of rigid piece 28 at the respective opposite ends of the clip; rigid connector clip 32 is positioned in surrounding relation to the portion 22d of piece 22 with the loop portion 32a passing the portion 22d of piece 22 in sliding fashion; the lower end 20c of flexible piece 20 is telescopically received over one end 32b of connector clip 32; the other end 32c of clip 32 is received telescopically within the lower end 24a of piece 24; and the upper end 24b of piece 24 defines a discharge end section adapted to be received in the user's mouth 14**.

In overview, and with the straw assembly positioned on the user's head, the assembly includes discharge end section 24b for insertion in the user's mouth, inlet end section 22b for insertion in the beverage to sipped, and a central section between the discharge end section and the inlet end section constituted by the upper portion of piece 22, pieces 28, 26 and 20, and the lower portion of piece 24.

It will be understood that, when thus assembled and thus positioned on the user's head, the invention straw assembly enables the user to suck beverage 18 from the cup 12 for passage through the continuous passage defined by the straw assembly and discharge it into the user's mouth. As the beverage moves from cup to mouth, it traverses the inlet end section 22b of piece 22, moves upwardly through section 22d of piece 22 for passage through the loop defined by connector clip 32, moves upwardly through the ascending portion defined by piece 22 along one side of the user's face, moves around and through the mouse ear configuration defined by the loop portion 28a of piece 28, moves through clip 30 and then around and through the mouse ear configuration defined by the loop portion 26a of piece 26, moves downwardly through the descending portion defined by piece 20 along the other side of the user's face, moves through connector clip 32 in looping fashion around portion 22d of piece 22, and moves upwardly through piece 24 and through discharge end section 24b for discharge into the user's mouth.

It will be understood that, as the beverage moves through the straw assembly, the beverage color shows through the straw assembly by virtue of the transparent nature of the pieces and, in the case of an effervescent beverage, the bubbly characteristic of the beverage also shows through the transparency of the pieces. The mouse ears defined by the loop portions 26a and 28a of pieces 26 and 28 will be seen to present an icon above the user's head, in this case, an icon in the form of mouse ears.

Connector clip 32 is positioned at the intersection of the ascending piece 22 and descending piece 20 and beneath the user's chin. Clip 32 thus effectively ties the pieces 20 and 22 together without interfering with the passage of the beverage therethrough and serves to positively position the straw assembly on the user's head and preclude inadvertent displacement of the straw assembly from the user's head.

As will be apparent, the sliding connection between clip 32 and piece 22 enables the straw assembly to be readily adjusted to fit virtually any size head and the multi-piece nature of the straw assembly, complete with clips 30 and 32, enables the straw assembly to be readily disassembled for package in a relatively small display configuration such for example as in a blister card display. It will be understood that the ascending and descending pieces 20 and 22 may, at the user's option, be arranged to pass either forwardly or rearwardly of the ears 16a of the user.

Figure 4:
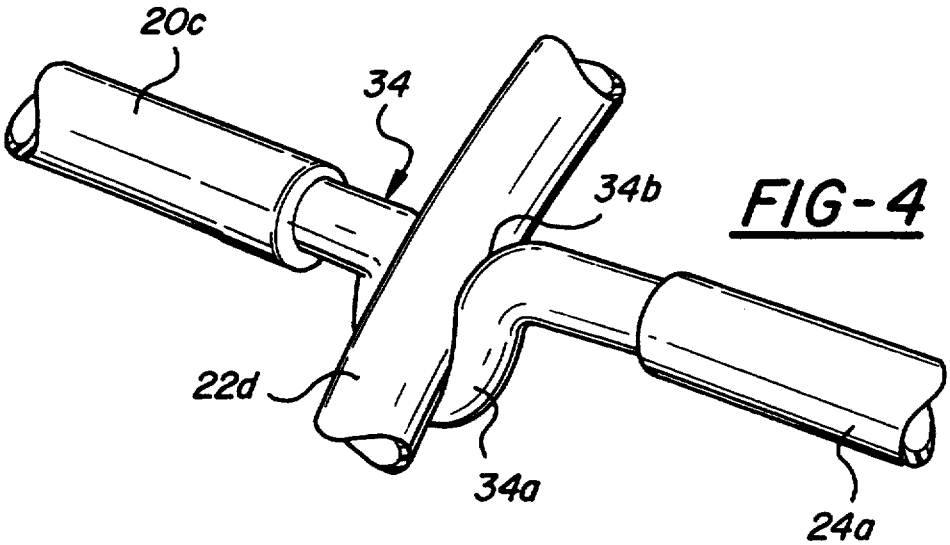
FIGS. 4 and 5 show alternate forms of connector clips for use in the invention straw assembly.
Figure 5:
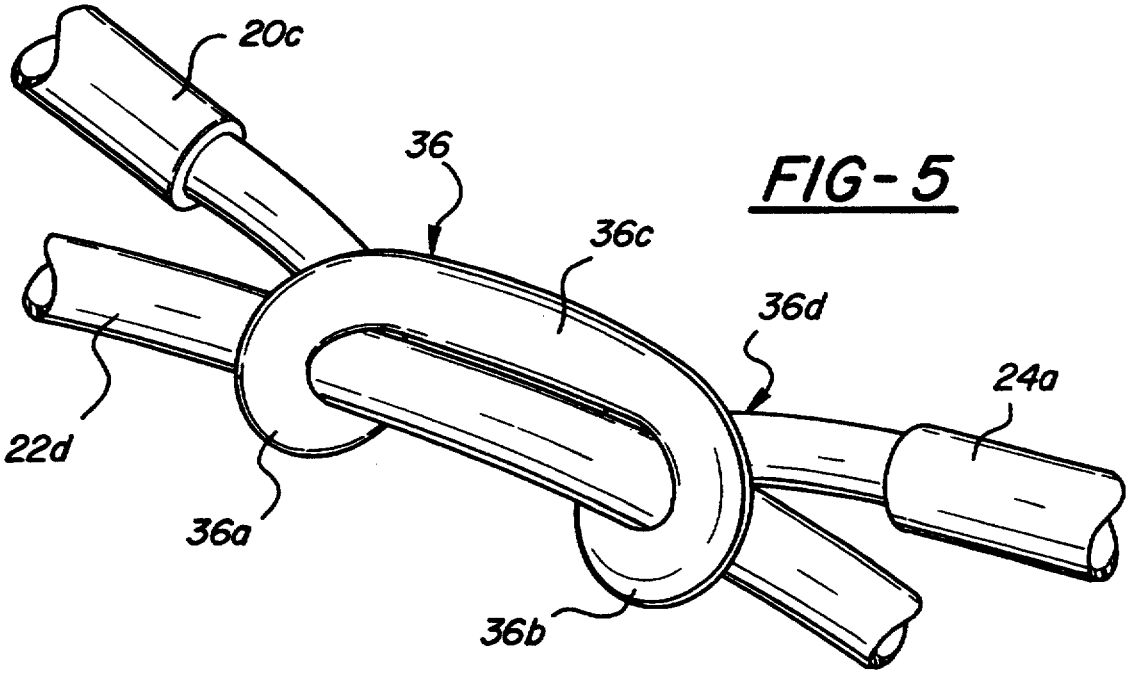
Figure 6:
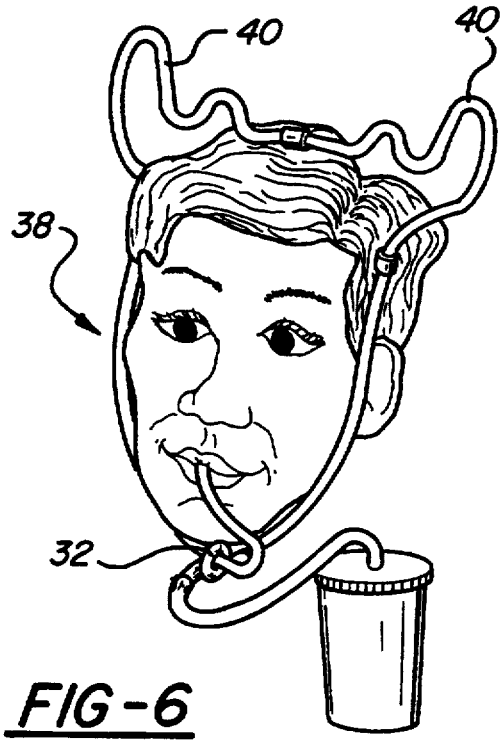
Figure 7:
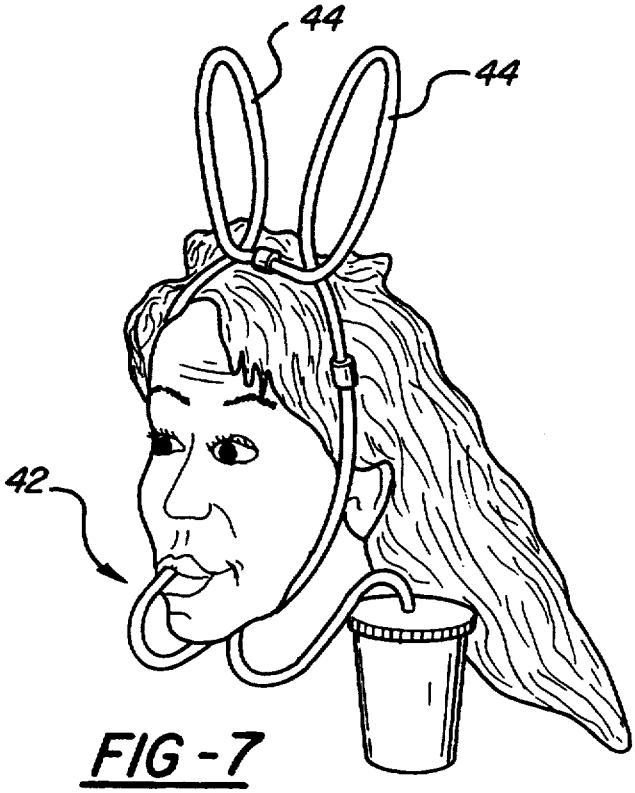
Figure 8:
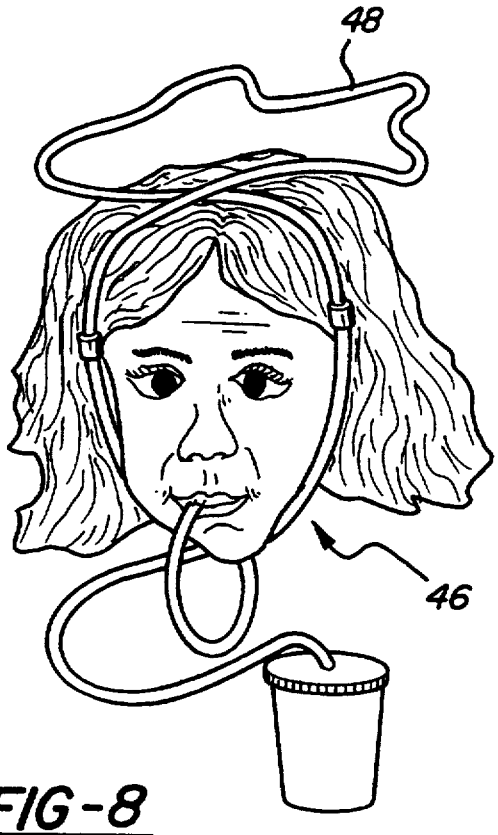
Figure 9:
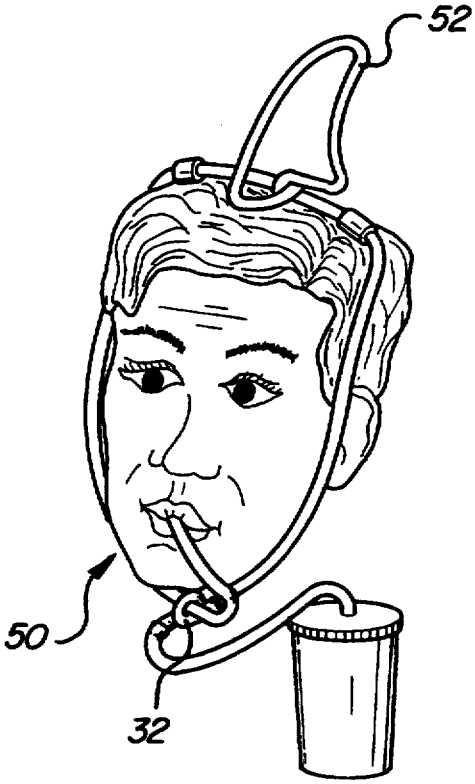
Figure 10:
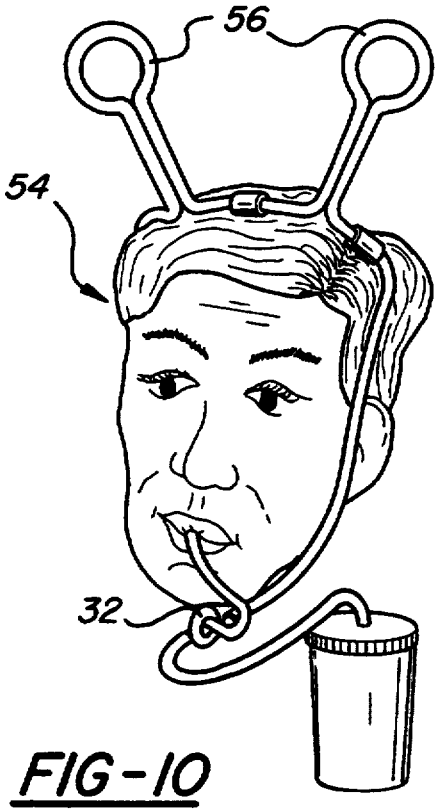
Figure 11:
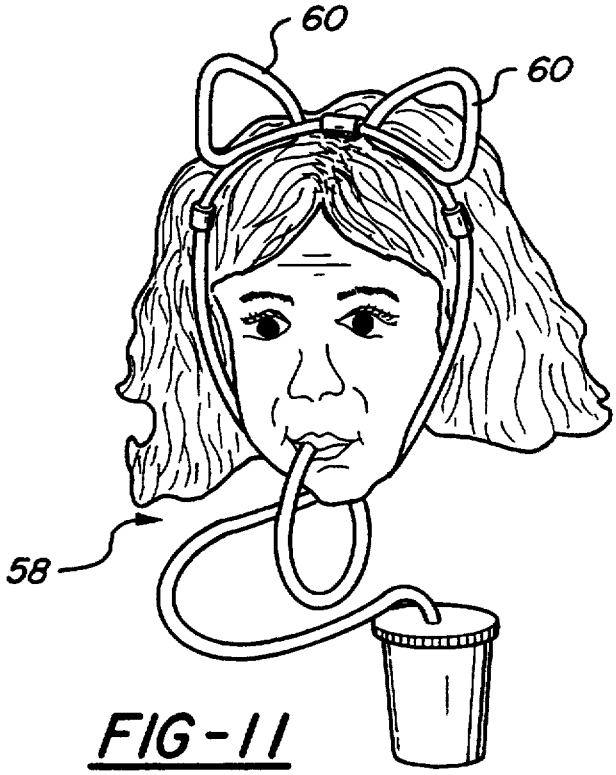
Figure 12:
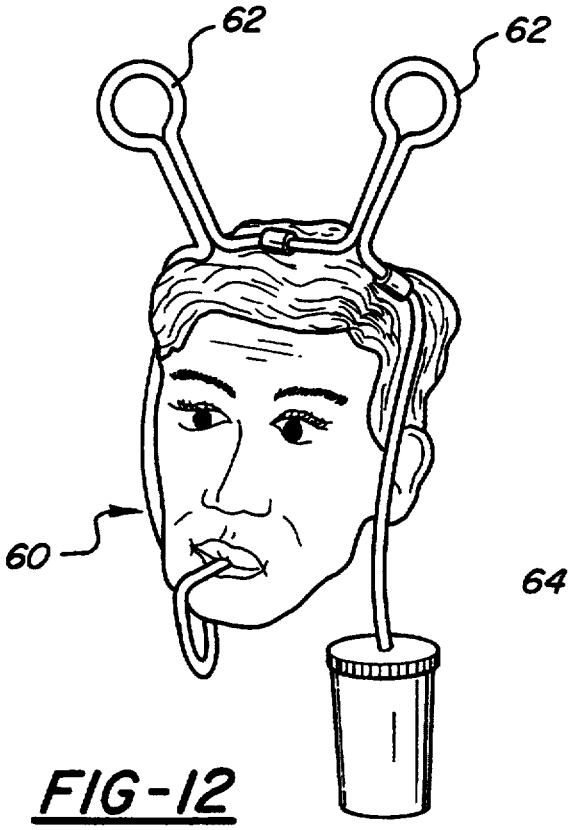
Figure 13:
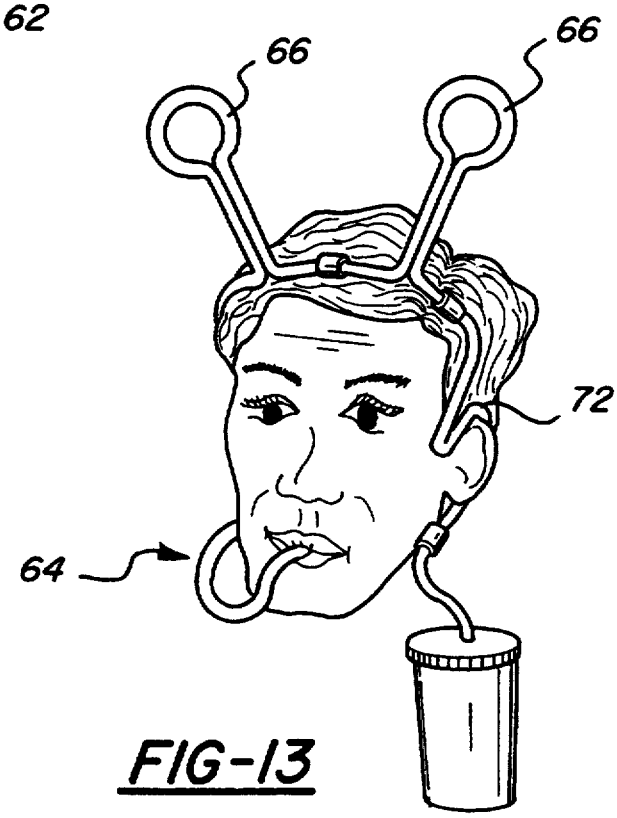

Alternate forms of connector clip 32 are shown in FIGS. 4 and 5. Specifically, as shown in FIG. 4, the connector clip may comprise a rigid clip 34 including an open loop portion 34a with portion 22d of piece 22 passing snappingly through the open end of the loop portion to position portion 22d firmly but slidably within the loop.

In a further alternative, and as seen in FIG. 5, the connector clip may comprise a rigid clip 36 including a pair of loop portions 36a and 36b arranged in series and connected by a joinder portion 36c. Loop portions 36a and 36b will be seen to define a channel 36d into which portion 22d of piece 22 may be inserted and in which portion the 22d is firmly but slidably held.

FIGS. 6 through 14 illustrate various forms and various configurations of the invention straw assembly. Specifically, the icon presented by the straw assembly 38 of FIG. 6 may comprise moose antlers 40; the icon presented by the straw assembly 42 of FIG. 7 may comprise bunny ears 44; the icon presented by the straw assembly 46 of FIG. 8 may comprise a fish 48; the icon presented by the straw assembly 50 of FIG. 9 may comprise a fin 52; the icons presented by the straw assemblies 54, 60 and 64 of FIGS. 10, 12 and 13 may comprise antennae 56, 62 and 66; the icon presented by the straw assembly 58 of FIG. 11 may comprise cat ears 60; and the icon presented by the straw assembly 68 of FIG. 13 may comprise bunny ears 70.

FIGS. 6 through 14 also illustrate various ways in which the straw assembly may be joined together and positioned on the user's head. Specifically, in FIGS. 6, 7 and 8, the ascending and descending sections of the straw assembly intersect beneath the user's chin utilizing clip 32; in FIGS. 7, 8 and 11 the ascending and descending sections intersect beneath the user's chin but are not clipped or intertwined; in FIGS. 12, 13 and 14 the ascending section does not intersect the descending section; in FIG. 13 the ascending section includes a portion 72 designed to be positioned behind the user's ear and the descending section is similarly configured; and in FIG. 14 the ascending and descending sections 74 and 76 intersect behind the user's head utilizing a connector clip 32 and the straw assembly is further configured to define a headband portion 78 positioned around the user's head above the ears and above the eyes in a generally horizontal disposition.

In all of the illustrated embodiments, it will be seen that the straw assembly is firmly positioned on the user's head and includes a portion positioned above the user's head and presenting an icon above the user's head. It will be understood that the icon portion facilitates a costume type straw enabling the user to don the appearance of an animal, a martian or any other desired appearance, thereby making the invention straw assembly extremely desirable in a play or party setting. It will further be seen that, in each embodiment, the assembly is comprised of a plurality of readily disassembled pieces or sections so that the straw assembly in each case may be readily packaged in a convenient blister package for sale and display purposes.

Whereas preferred embodiments of the have been illustrated and described in detail, it will be apparent that various changes may be made in the disclosed embodiment without departing from the scope or spirit of the invention.

I claim:

1. A tubular drinking straw assembly including a discharge section at one end of the assembly adapted to be inserted in the user's mouth, an inlet section at the other end of the assembly adapted to be inserted into a beverage to be sipped, and a central section between the discharge end section and the inlet end section, characterized in that:

the central section is configured to be positioned on the head of the user; and the central section, when positioned on the user's head, presents a portion extending above the user's head and defining an icon above the user's head, an ascending portion connected at a lower end thereof to the inlet section and extending upwardly along one side of the user's face in front of the respective ear for connection at an upper end thereof to one end of the icon portion, and a descending portion connected at an upper end thereof to the other end of the icon portion and extending downwardly along the other side of the user's face in front of the respective ear for connection at a lower end thereof to the discharge section, wherein, with the central section positioned on the user's head, the ascending and descending portions intersect.

2. A straw according to claim 1 wherein:

the ascending portion and the descending portion intersect beneath the chin of the user.

3. A straw according to claim 1 wherein:

the icon comprises an animal depiction.

4. A straw according to claim 3 wherein:

the animal depiction comprises an animal appendage.

5. A straw according to claim 4 wherein:

the animal appendage comprises animal ears.

6. A straw according to claim 4 wherein:

the animal appendage comprises a fin.

7. A straw according to claim 4 wherein:

the animal appendage comprises animal antlers.

8. A straw according to claim 3 wherein:

the animal depiction comprises an outline of a total animal.

9. A tubular drinking straw assembly including a discharge section at one end of the assembly adapted to be inserted in the user's mouth, an inlet section at the other end of the assembly adapted to be inserted into a beverage to be sipped, and a central section between the discharge end section and the inlet end section, characterized in that:

the central section is configured to be positioned on the head of the user;

the central section, when positioned on the user's head, presents a portion extending above the user's head and defining an icon above the user's head;

the central section further includes a first portion connected to one end of the icon portion and a second portion connected to the other end of the icon portion; and with the central section positioned on the user's head, the first and second portions intersect and the portions are intertwined at their intersection.

10. A straw according to claim 9 wherein:

the intertwining comprises a loop formed in one of said intersecting portions and passing the other of said intersecting portions, 11. A straw according to claim 10 wherein:

the loop is a closed loop totally surrounding the other intersecting portion,

12. A straw according to claim 10 wherein:

the loop is an open loop with the other intersecting portion passed through the open end of the loop, 13. A straw according to claim 9 wherein:

the intertwining comprises a plurality of loops formed in one of said intersecting portions and passing the other of said intersecting portions, 14. A straw according to claim 9 wherein:

said intersecting portions are intertwined behind the head of the user.

15. A tubular drinking straw assembly including a discharge section at one end of the assembly adapted to be inserted in the user's mouth, an inlet section at the other end of the assembly adapted to be inserted into a beverage to be sipped, and a central section between the discharge end section and the inlet end section, characterized in that:

the central section is configured to be positioned on the head of the user and includes an ascending portion connected to one end of the inlet end section and extending upwardly with respect to the user's head from the inlet end section and a descending portion extending downwardly with respect to the user's head for connection to one end of the discharge end section; and the ascending portion and descending portion intersect beneath the chin of the user and are intertwined at their intersection.

16. A straw according to claim 15 wherein:

the central section further includes an icon portion connected at one end to one end of the ascending portion, connected at its other end to one end of the descending portion, and extending above the user's head to define an icon above the user's head.

17. A straw according to claim 16 wherein:

the icon comprises an animal depiction.

18. A straw according to claim 17 wherein:

the animal depiction comprises an animal appendage.

19. A straw according to claim 18 wherein:

the animal appendage comprises animal ears.

20. A tubular drinking straw assembly including a discharge section at one end of the assembly adapted to be inserted in the user's mouth, an inlet section at the other end of the assembly adapted to be inserted into a beverage to be sipped, and a central section between the discharge end section and the inlet end section, characterized in that:

the central section is configured to be positioned on the head of the user; and the central section, when positioned on the user's head, presents a portion extending above the user's head and defining an icon above the user's head, an ascending portion connected upwardly along one side of the user's head for connection at an upper end thereof to one end of the icon portion, and a descending portion connected at an upper end thereof to the other end of the icon portion and extending downwardly along the other side of the user's head for connection at a lower end thereof to the discharge section, wherein, with the central section positioned on the user's head, the ascending and descending portions intersect.

* * * * *